United States Patent [19]

Jarnott et al.

[11] Patent Number: 4,838,449

[45] Date of Patent: Jun. 13, 1989

[54] SECTIONAL STORAGE TANKS

[75] Inventors: Frank T. Jarnott, Southampton; Leslie S. Norwood, Rushden, both of England

[73] Assignee: Scott Bader Company Limited, Wellingsborough, England

[21] Appl. No.: 793,718

[22] Filed: Oct. 30, 1985

Related U.S. Application Data

[63] Continuation of Ser. No. 531,824, Sep. 13, 1983, abandoned.

[30] Foreign Application Priority Data

Sep. 17, 1982 [GB] United Kingdom ..... 8226555

[51] Int. Cl.[4] ..... B65D 6/34; B65D 6/00; B65D 88/02

[52] U.S. Cl. ..... 220/5 A; 220/71; 220/83

[58] Field of Search ..... 220/5 A, 71, 83

[56] References Cited

U.S. PATENT DOCUMENTS

| | | | |
|---|---|---|---|
| 1,033,913 | 7/1912 | Lloyd | 220/5 A |
| 1,496,585 | 6/1924 | Mangrum | 220/5 A |
| 1,686,931 | 9/1928 | Russell | 220/71 |
| 1,981,568 | 11/1934 | Owen | 220/5 A |
| 4,193,510 | 3/1980 | Weston | 220/83 |
| 4,421,827 | 12/1983 | Phillips . | |

FOREIGN PATENT DOCUMENTS

| | | | |
|---|---|---|---|
| 69238 | 11/1975 | Australia | 220/5 A |
| 2526627 | 12/1976 | Fed. Rep. of Germany | 220/5 A |
| 8512 | 1/1977 | Japan | 220/5 A |
| 29611 | 3/1977 | Japan | 220/5 A |
| 40811 | 3/1977 | Japan | 220/5 A |

OTHER PUBLICATIONS

Bulletin of the International Association for Shell and Spatial Structures, No. 75, Apr. 1981, pp. 35–44; No. 69, Apr. 1979, pp. 43–48.

*Primary Examiner*—George E. Lowrance
*Attorney, Agent, or Firm*—Merchant, Gould, Smith, Edell, Welter & Schmidt

[57] ABSTRACT

A storage tank has side walls (100) each assembled from a plurality of panels (1), preferably of metal clad GRP, interconnected with one another. The panels (1) are each of hyperbolic paraboloid ("hypar") shape thus providing a concave surface (3) which, on assembly of the tank, faces out. The tanks may be strengthened by internal bracing (500) under tension or external bracing under compression.

8 Claims, 17 Drawing Sheets

58
58
50
52
66
80
80
70
71
P
a
b
c
d
e
f
g
h
j
k
l
m
n

SECTIONAL STORAGE TANKS

This is a continuation of application Ser. No. 531,824, filed Sept. 13, 1983.

FIELD OF THE INVENTION

This invention relates to sectional tanks particularly for the storage of liquids.

BACKGROUND OF THE INVENTION

Sectional tanks for the storage of, for example, water have commonly been made from mild steel and in latter years also from glass reinforced polyester resins (GRP). They are constructed from panels (also known as "shells" or "decks") with flanges which are bolted together with a sealant between each joint. Those made of steel usually have a star pattern embossed in the panel and whilst the earlier GRP tanks had the same pattern later examples have been flat panels. Tanks 4 ft high usually need minimal bracing but tanks 8 ft high and above need external and/or internal bracing to withstand the pressures and deflections encountered when full of water or other liquid.

For ease of construction it is desirable to minimize the number of panels which need to be assembled by using relatively large panels. Typically, for a GRP tank up to 8 ft high, 4 ft square panels may be used. However the larger the panels the less capable they are of withstanding the load of the liquid to be stored and it is therefore necessary, for taller tanks, to use smaller panels, say (2"×4"), at least for the base and lowermost side panels which will take the greatest load; thus it is necessary in constructing a tall sectional tank to use a large number of small panels or to use panels of different sizes.

Typical weights of 4 ft square tank panels are 70 kg for steel and 30 kg for GRP, a 2×4 GRP panel weighing 20 kg. Although GRP panels are preferred because of their lower weight, such panels may undergo deterioration due to the fluid inside the tank (long term contact can cause blistering and moisture ingress into the laminate which causes a breakdown of the glass/resin bond and a lowering of strength).

It is also well known to assemble roofing structures from a plurality of panels of hyperbolic paraboloid shape which are known as "hypar" shells. These are assembled so that their concave surfaces face inwardly of the building of which they form the roof, as illustrated in an article by S. S. Nielsen, I.A.S.S. Bulletin (1981), XXII-1, No. 75, pages 35–44. The effect of long-term deflection of inverted umbrella hyperbolic paraboloid shells has been measured and the results published in an article by Srihari et al, I.A.S.S. Bulletin (1979), XX-1, No. 69, pages 43–48.

SUMMARY OF THE INVENTION

We have now found that a sectional tank can be constructed entirely from panels which, though they each have a relatively large surface area (say 4 ft square), are capable of withstanding much higher loads than panels of the same cross-sectional area used in conventional GRP tanks. Side wall panels of a tank in accordance with the invention are of the hyperbolic paraboloid shape (hereinafter called "hypar") referred to above with respect to roof panels. At least the side walls of the tanks are assembled from a plurality of such panels which are interconnected with one another so that the concave surfaces of the panels face outwardly of the tank (not inwardly as roofing panels described above). Internal restraining links under tension run between panels on respective different faces of the tank. Such a construction gives an extremely strong, robust light-weight tank. The links may pass directly across the tank between opposite tank walls or run between any pair of walls or between any wall and the base. Alternatively or additionally the whole tank can be externally braced. An externally braced tank preferably also has at least minimal internal bracing to accommodate wind loading.

When using the abovementioned hypar panels, tall tanks may be constructed entirely from panels of relatively large cross-sectional area, i.e. without the necessity for using smaller panels at the base of the tank. For example, tanks higher than 8 ft may be constructed entirely from 4 ft square hypar panels.

Preferably the base of the tank is also constructed from hypar panels interconnected so that their concave surfaces face outwardly, but the roof is preferably constructed from hypar panels interconnected so that the convex surfaces face outwardly to allow draining of rain water falling on the roof.

The panels may be of steel or fibre reinforced plastics material, preferably glass reinforced plastics material (GRP). However, particularly preferred materials for the tanks are the GRP metal clad laminates described in British Patent Publication No. 2092950 and copending U.S. Pat. No. 4,421,827 filed Jan. 18, 1982, these having metal facings which provide the internal surface of the tank rendering it impervious to liquid. By using such materials, the imperviousness of the metal is combined with the higher strength/weight ratio of GRP to provide a tank of reduced weight having an internal surface which is resistant to water and other chemicals.

Depending upon the size of tank required, the number of panels which together make up a surface of the tank can be varied at will.

DESCRIPTION OF PREFERRED EMBODIMENTS

Figure 1:
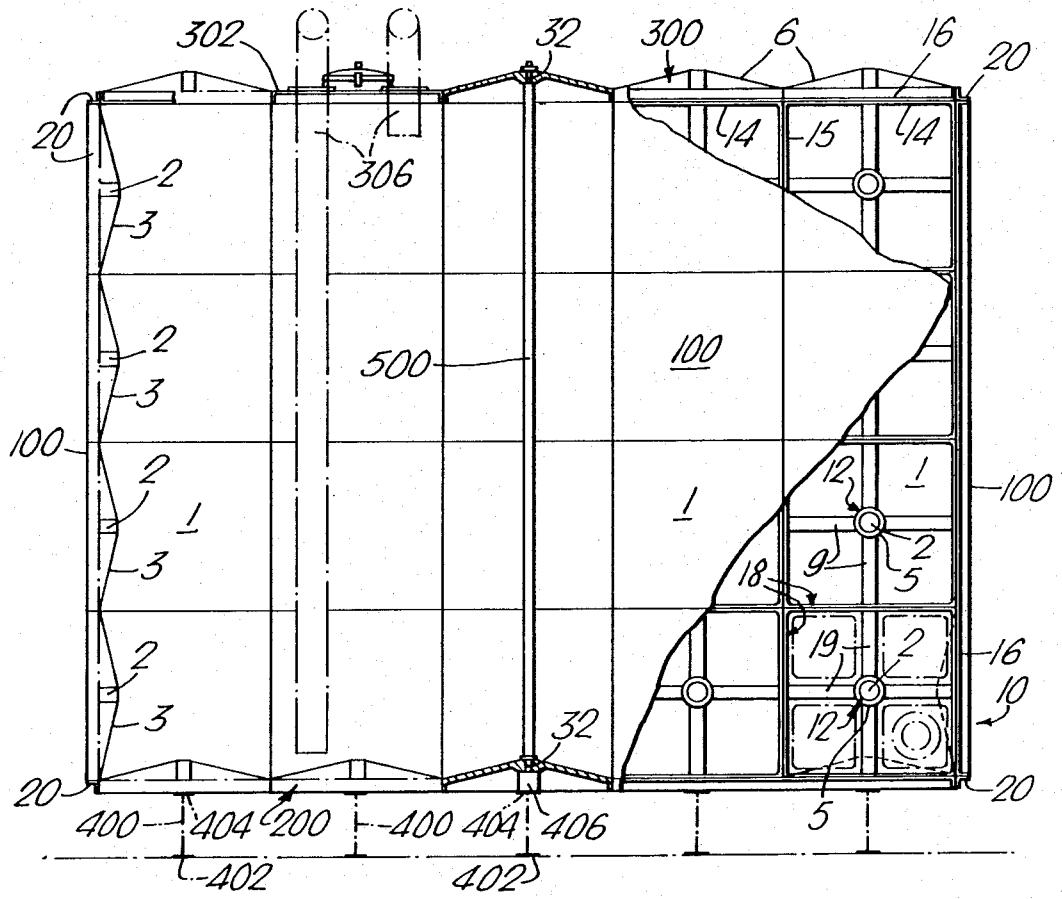

Tanks embodying the invention will now be described in more detail with reference to the accompanying drawings in which:

FIG. 1 is a front elevation of a tank in accordance with the invention constructed from a plurality of hypar panels, with a part of the front wall broken away and a central part in section, details of the front wall also being omitted for clarity.

Figure 2A:
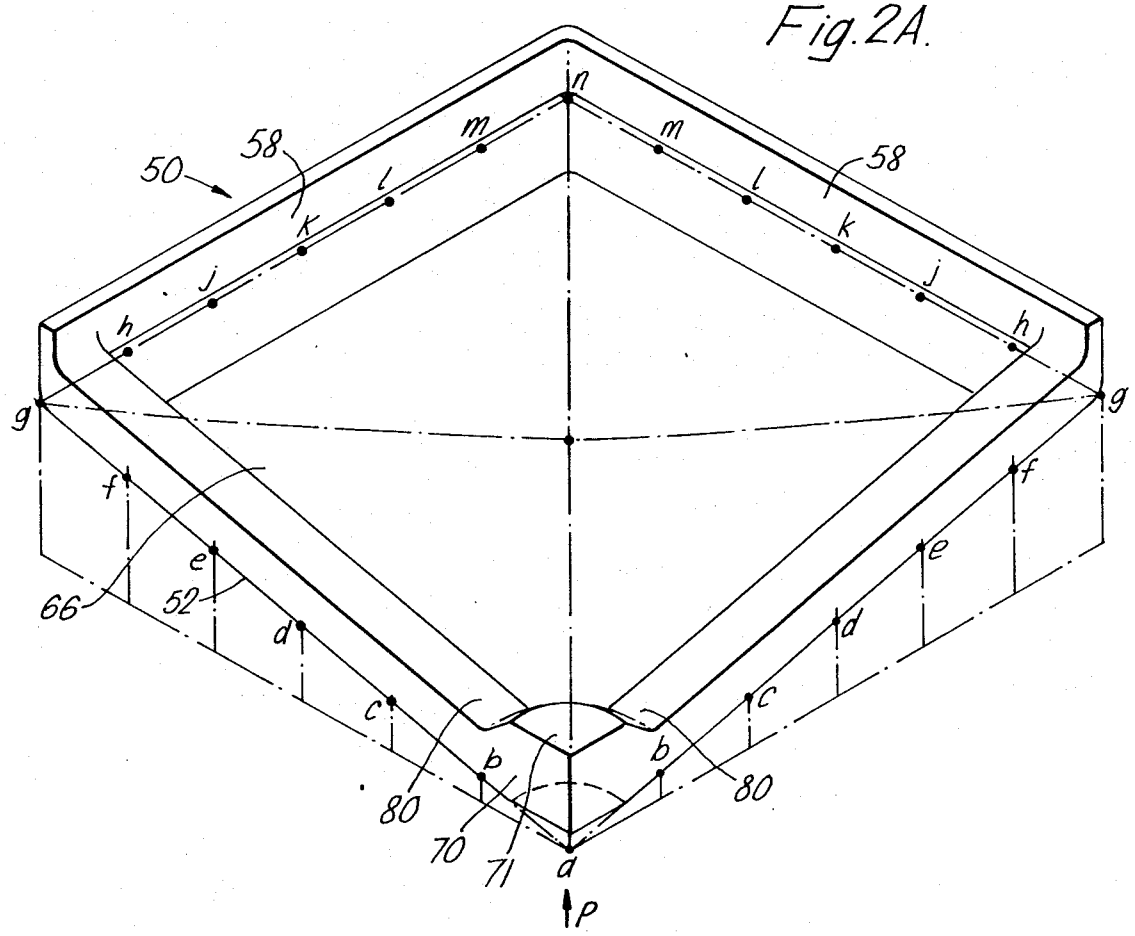
Figure 2B:
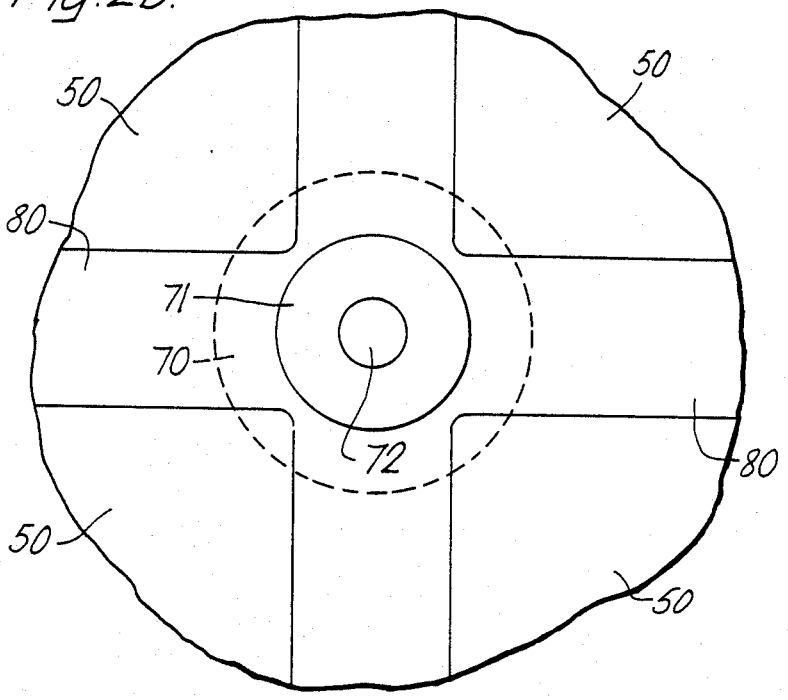
Figure 2C:
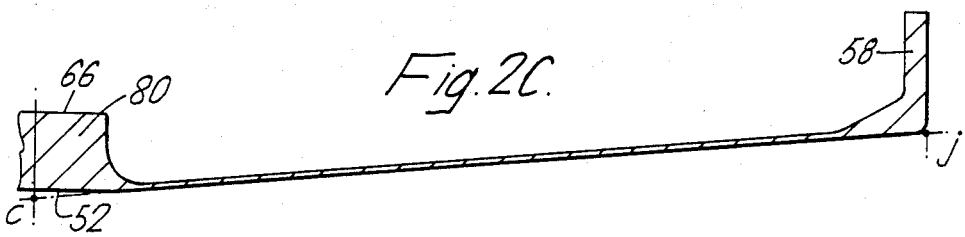
Figure 2E:
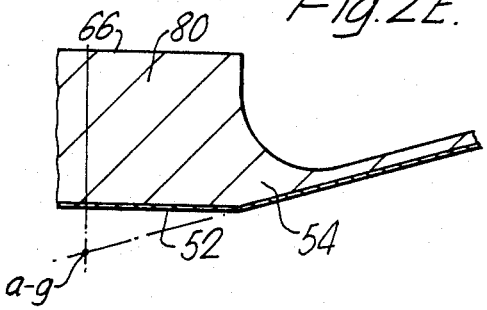
Figure 2D:
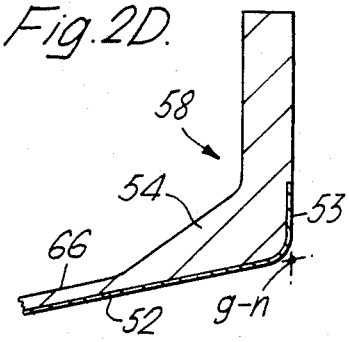
Figure 3A:
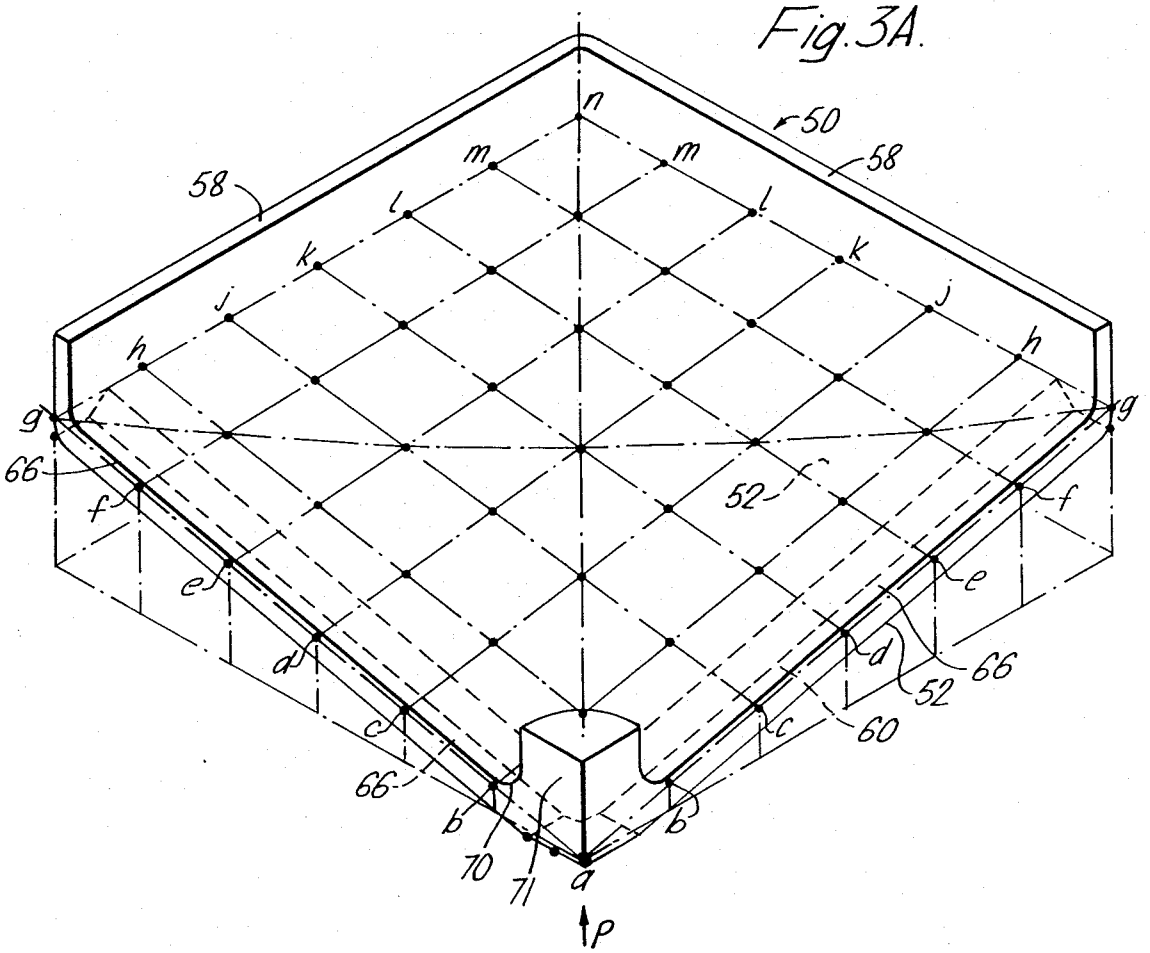
Figure 3B:
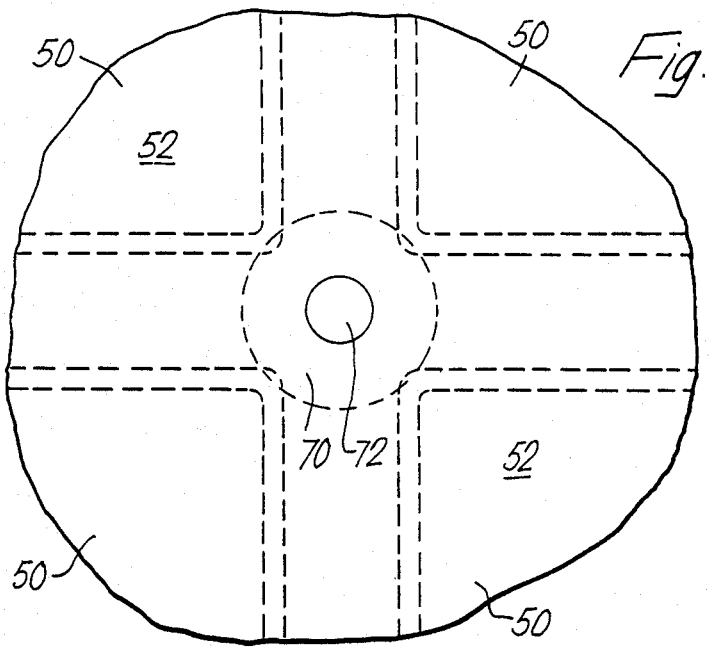
Figure 3C:
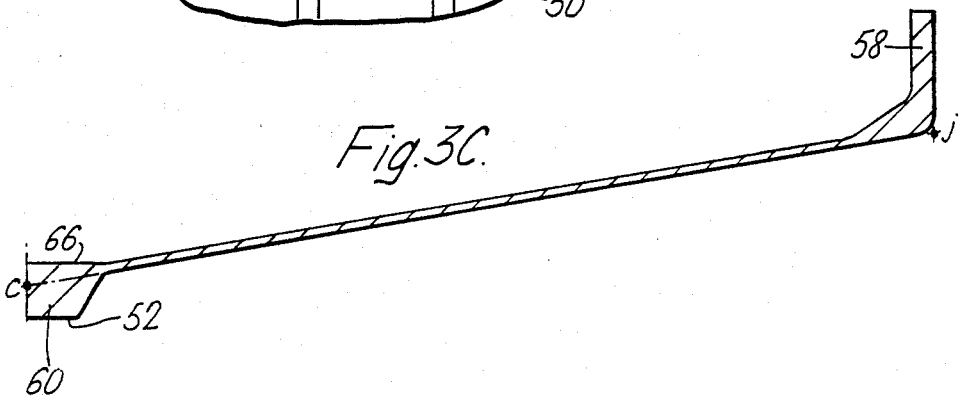
Figure 3D:
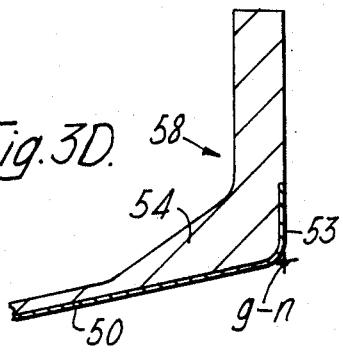
Figure 3E:
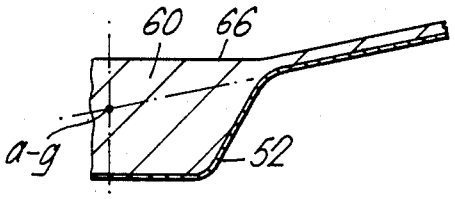
Figure 4A:
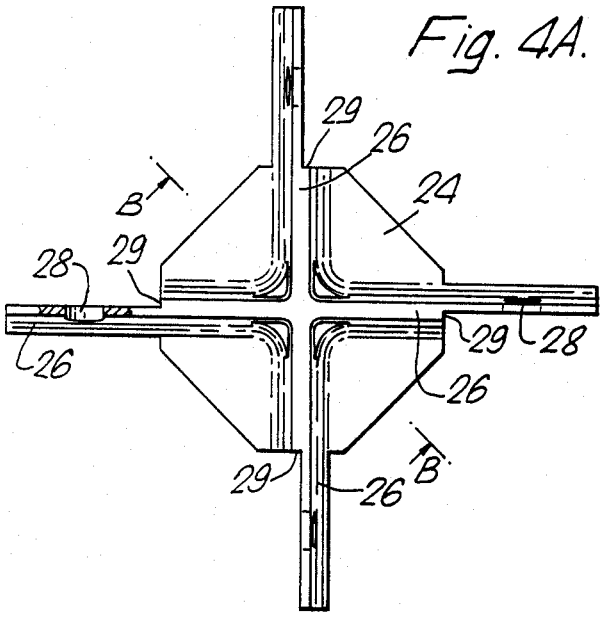
Figure 4B:
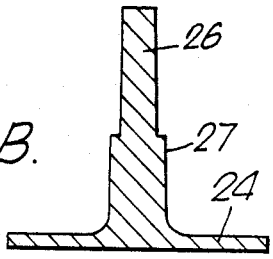
Figure 4C:
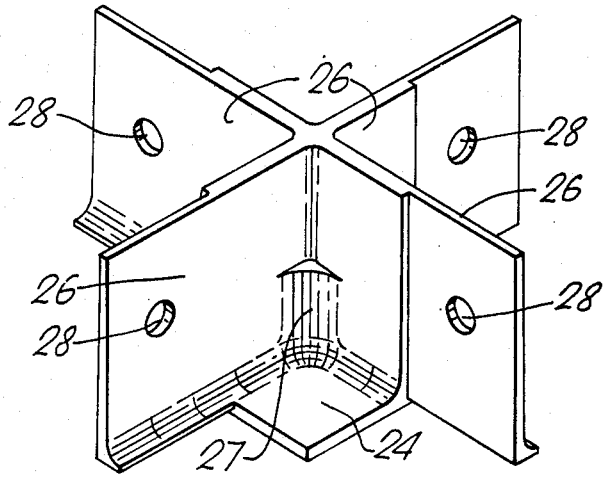
Figure 5A:
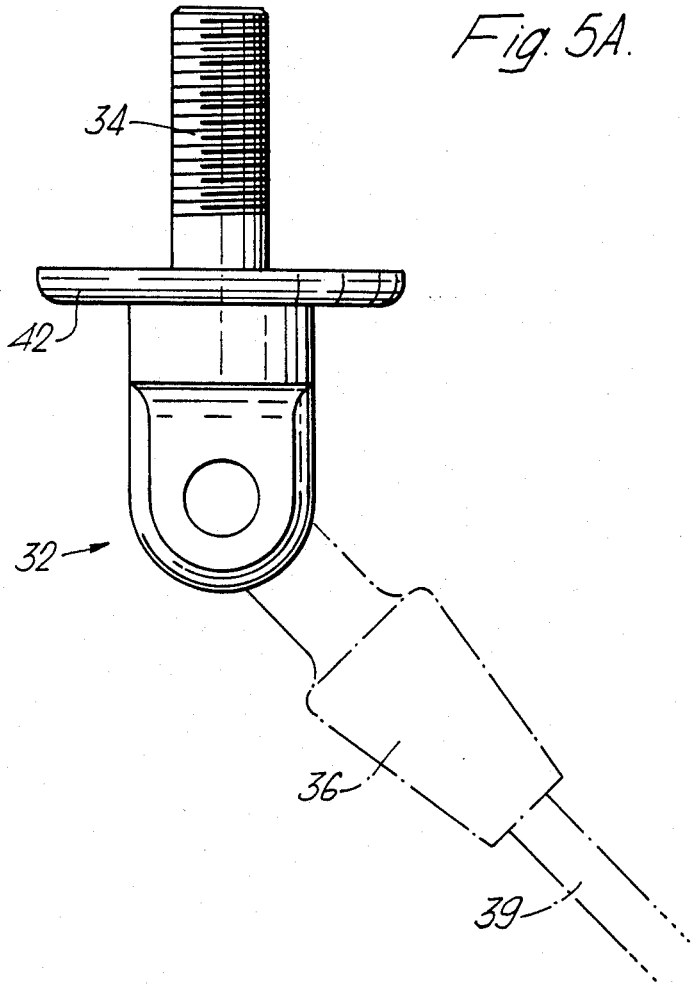
Figure 5B:
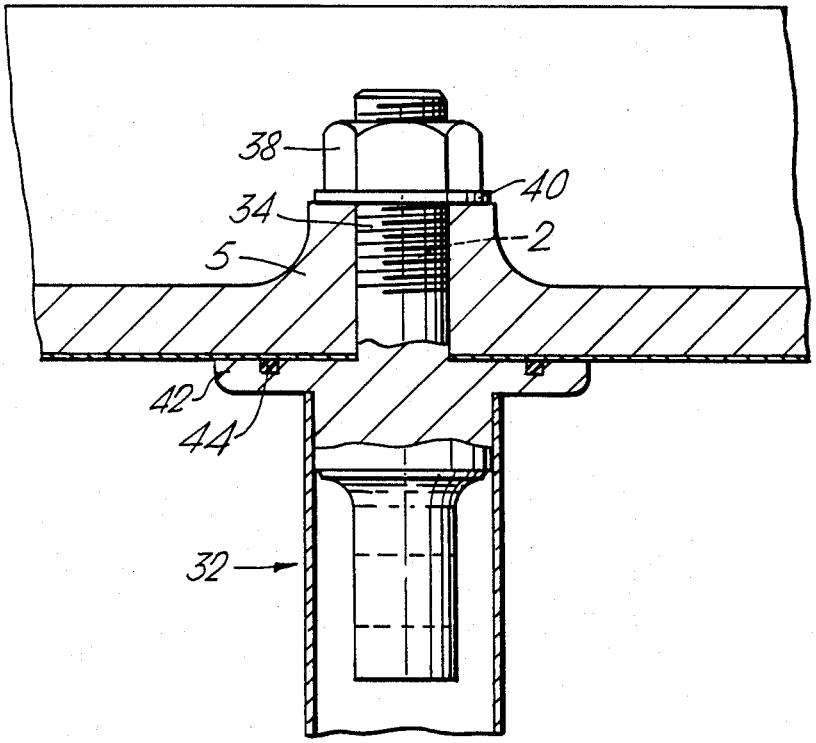
Figure 6A:
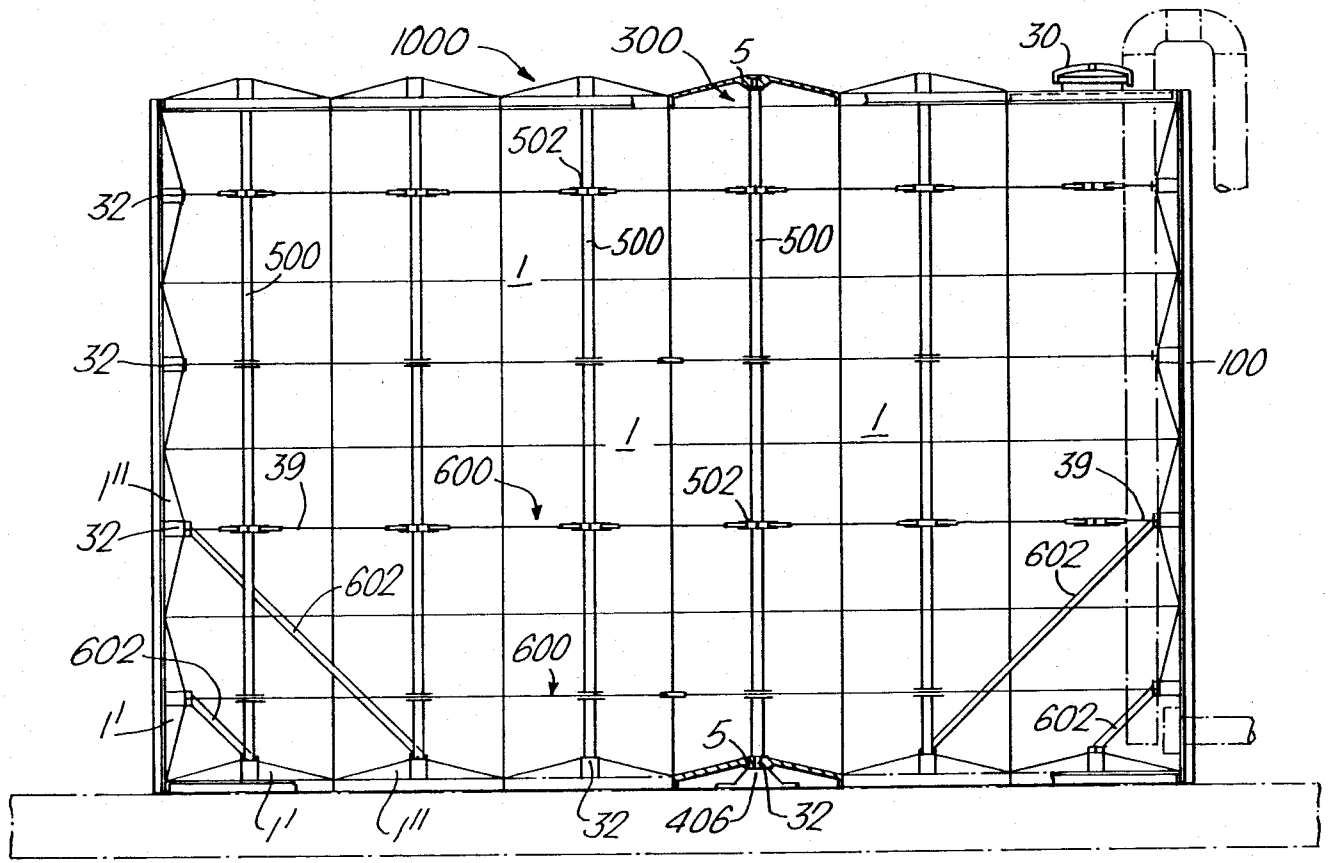
Figure 6B:
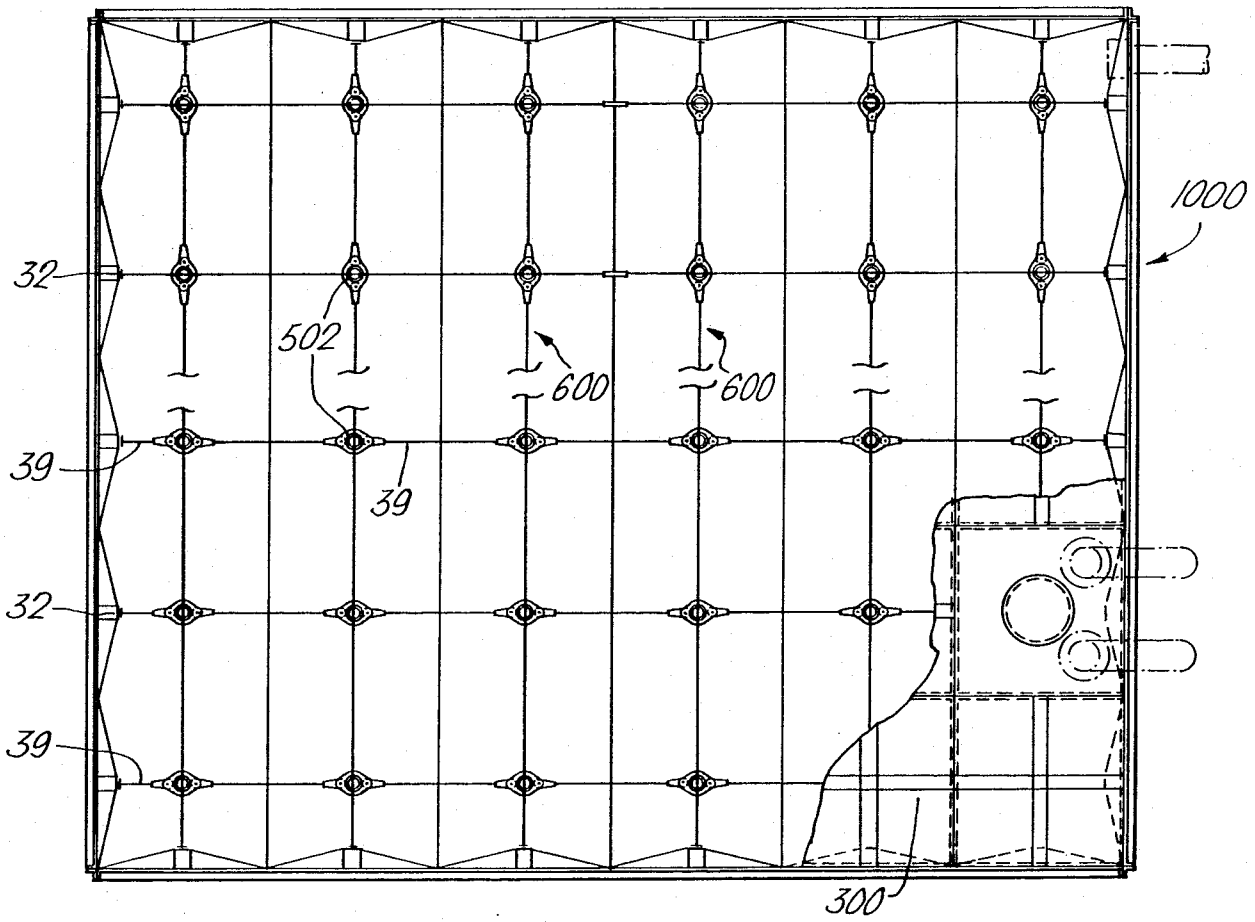
Figure 7A:
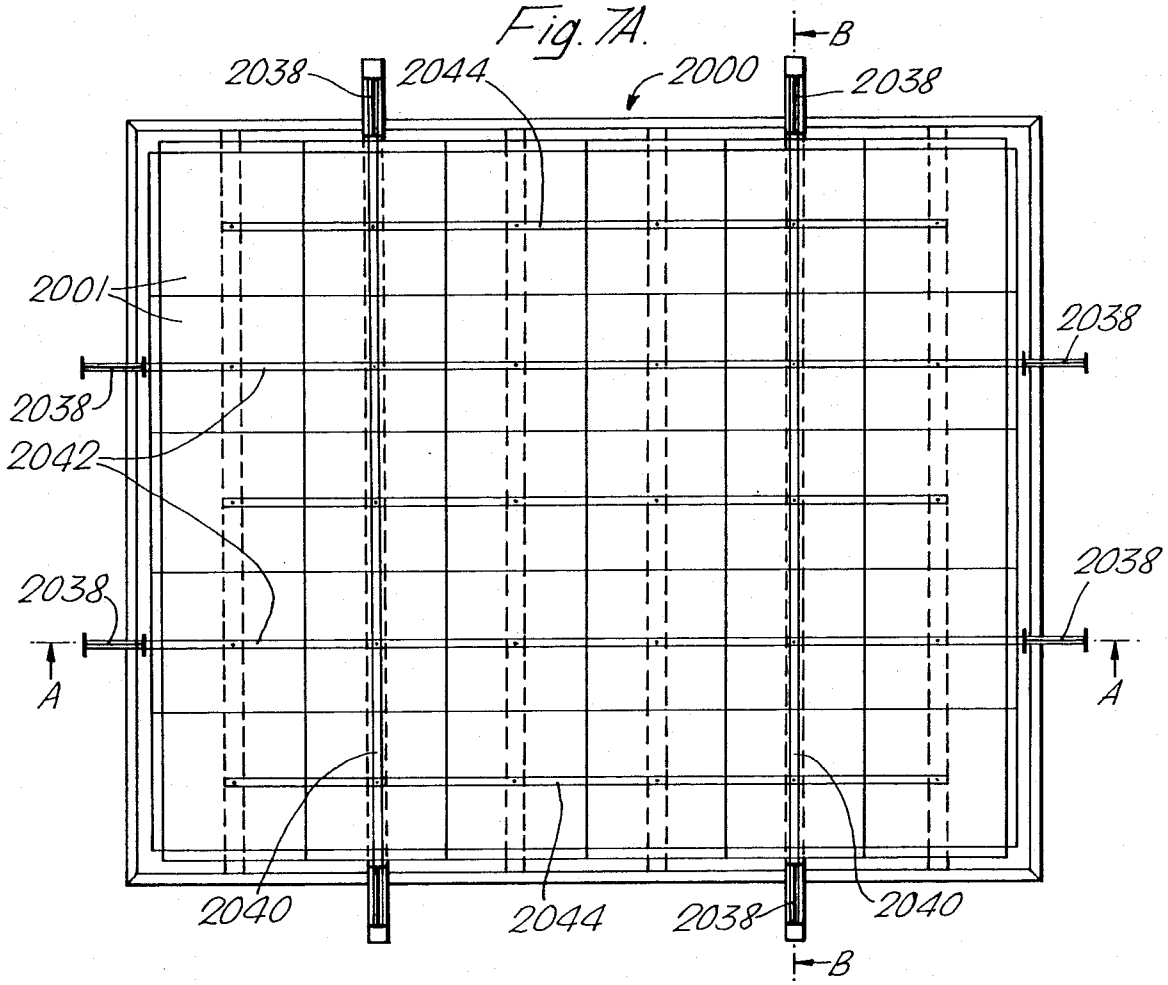
Figure 7B:
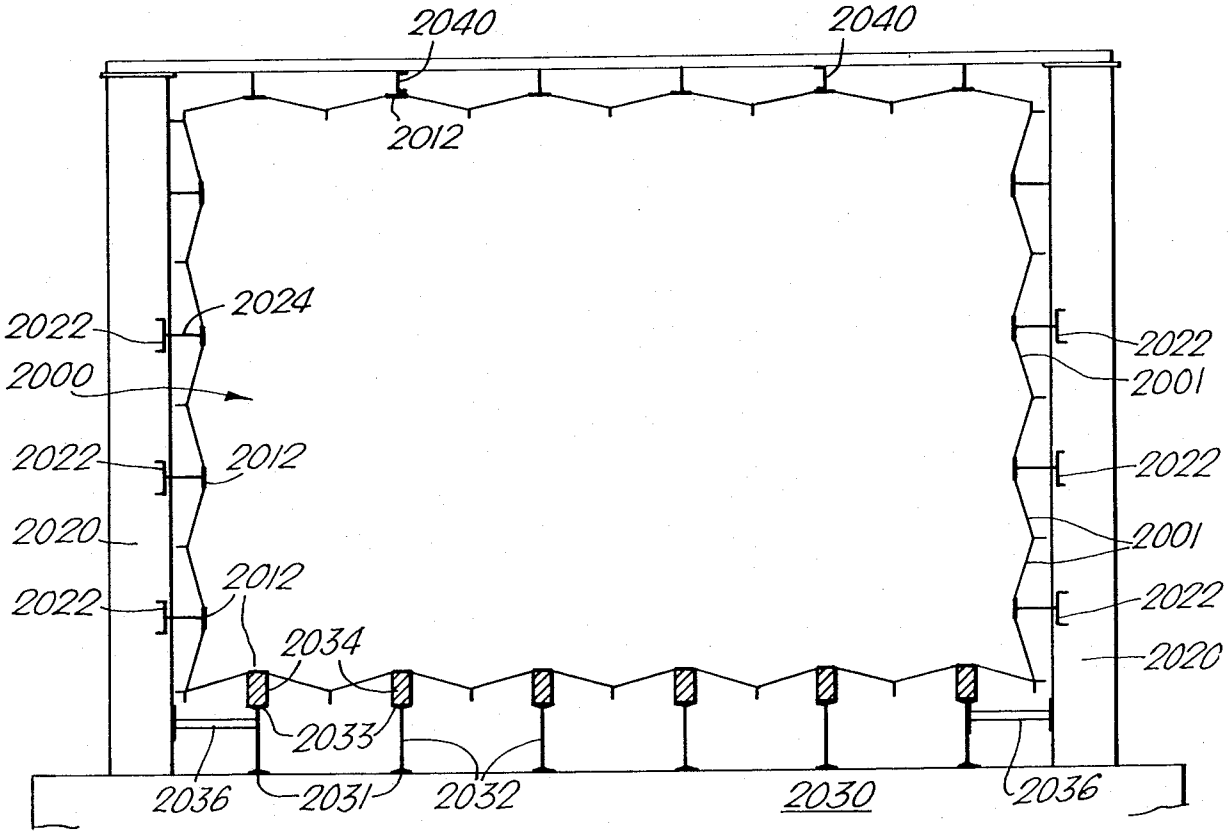
Figure 7C:
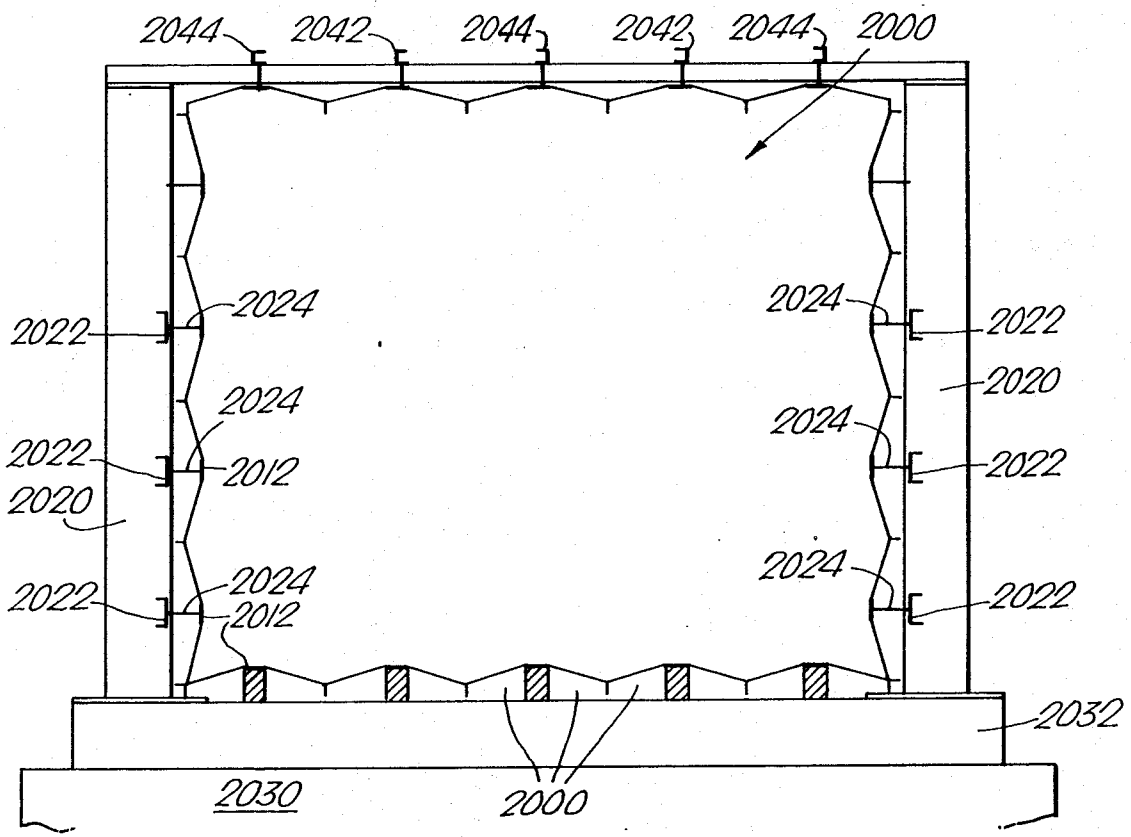
Figure 8A:
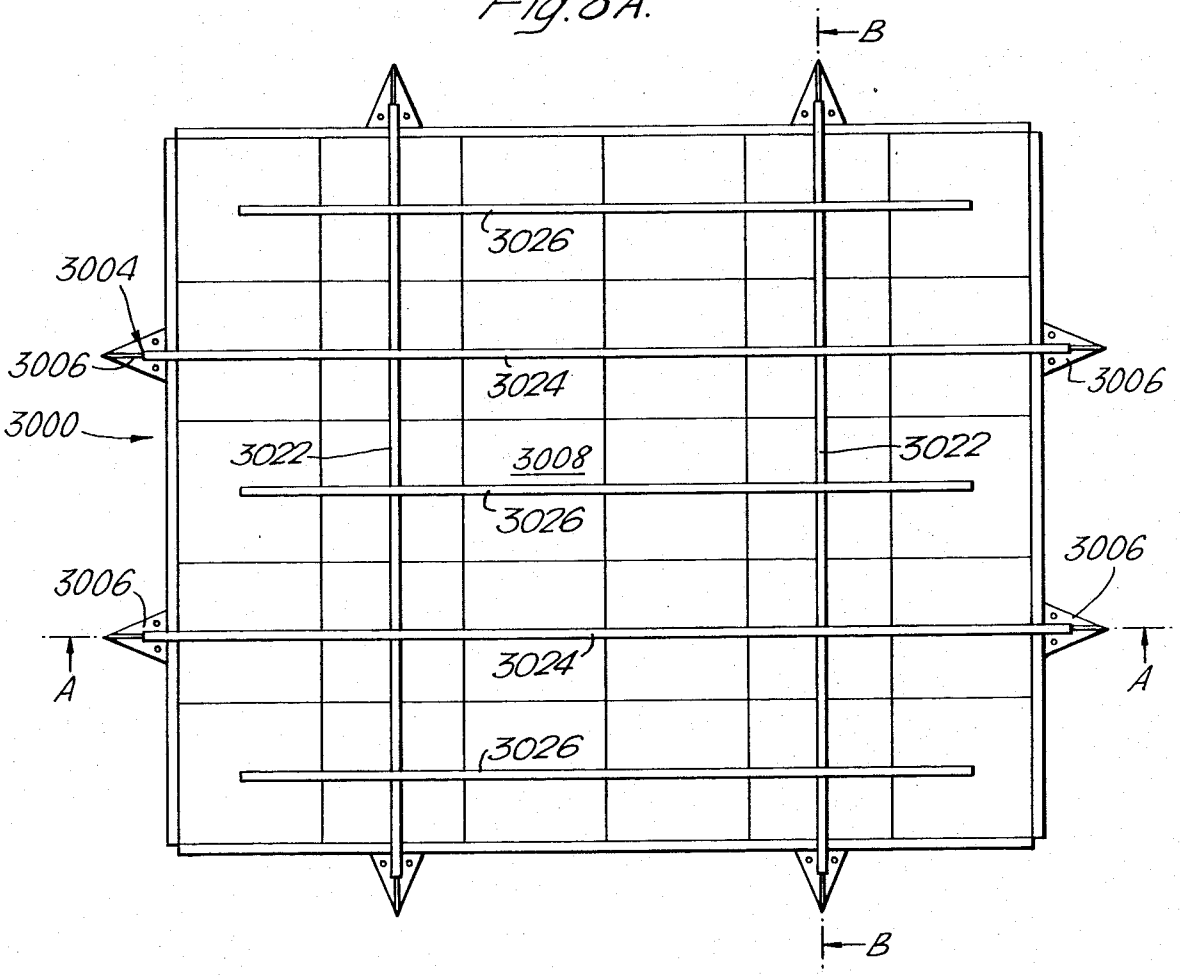
Figure 8B:
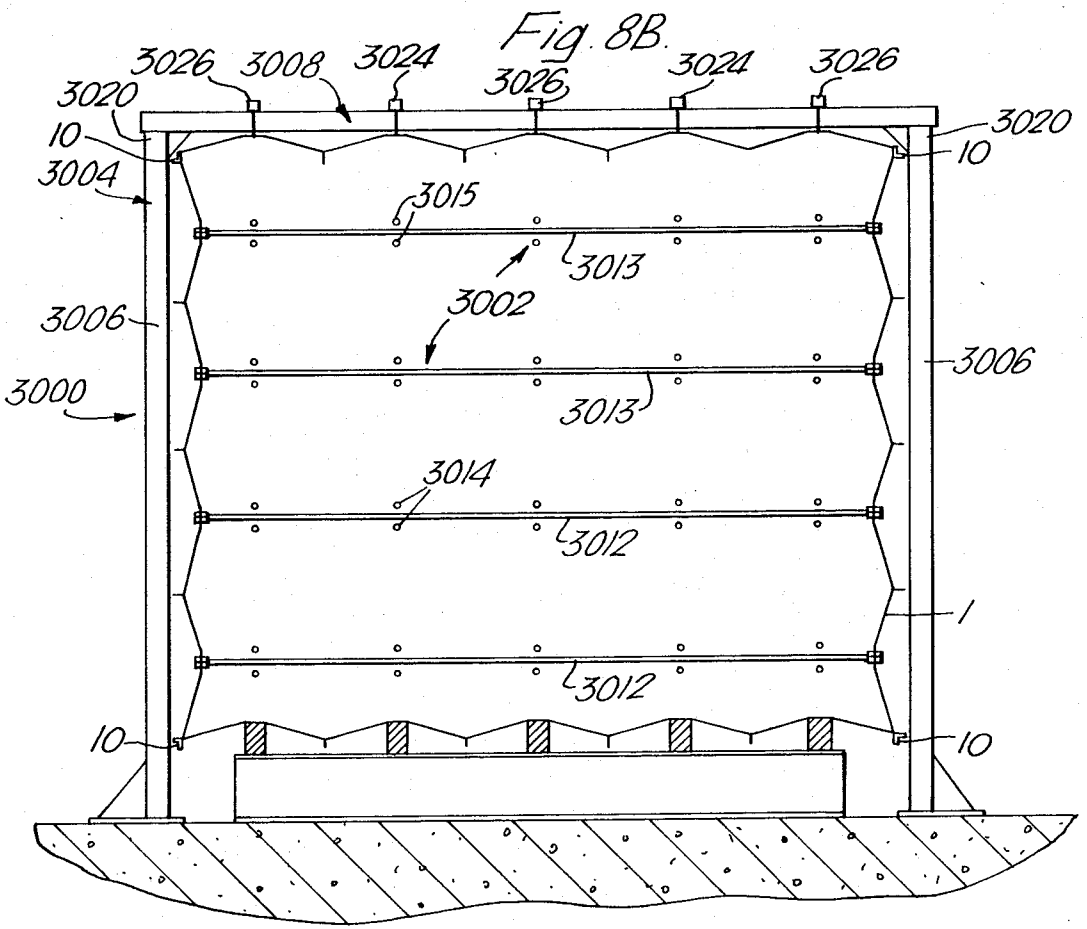
Figure 8C:
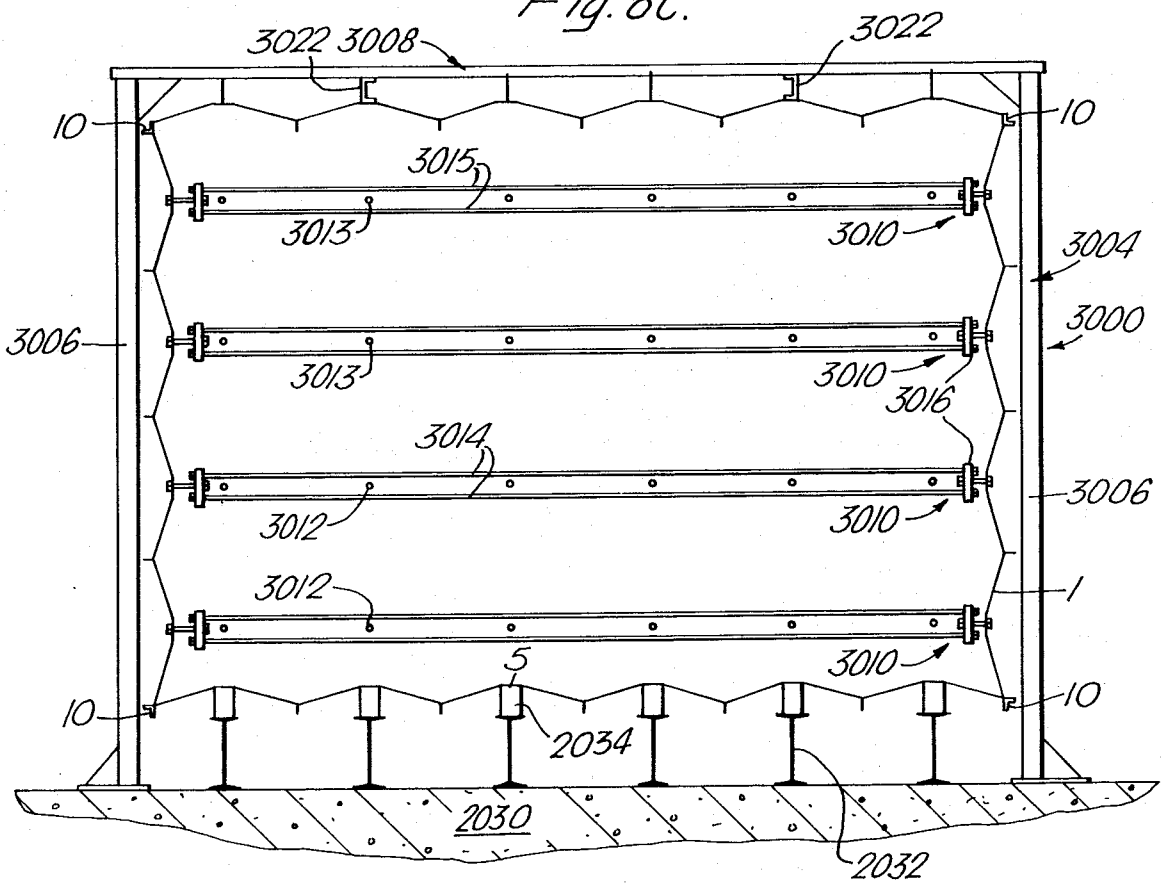
Figure 8D:
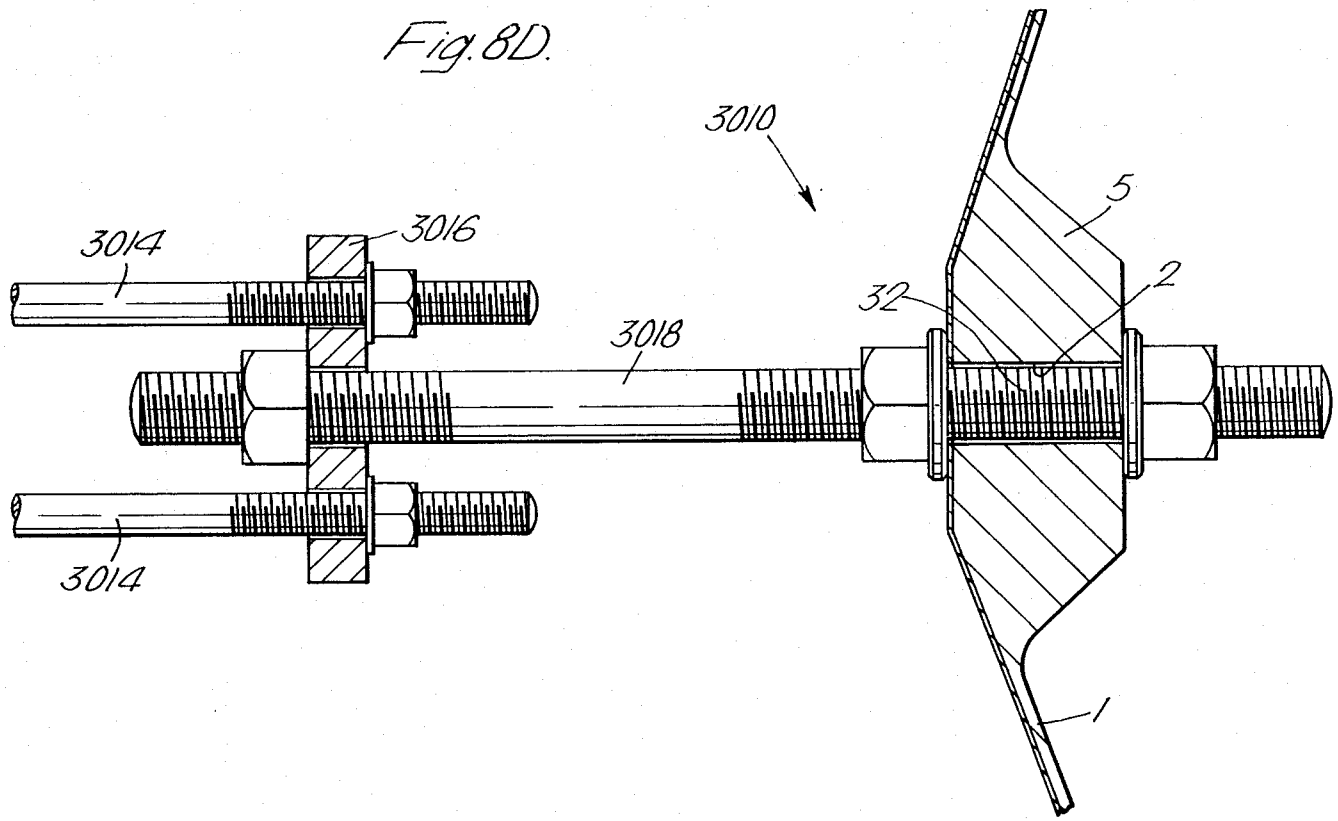

FIG. 2A is an isometric view of a quarter of one form of hypar panel from which the tank of FIG. 1 is constructed, FIG. 2B is a view in the direction P indicated in FIG. 2A showing the centre of a panel the quarter of which is shown in FIG. 2A, FIG. 2C is a section on the line connecting points j and c of FIG. 2A, FIG. 2D is a more detailed section of a flange part of the quarter of FIG. 2A and FIG. 2E is a more detailed section of a spine beam part of the quarter of FIG. 2A, FIG. 3A is an isometric view of a quarter of a panel providing an alternative to that of FIG. 2, FIG. 3B is a view in the direction P showing the centre of the panel the quarter of which is shown in FIG. 3A, FIG. 3C is a section on the line joining points j and c on FIG. 3A, FIG. 3D is a more detailed section of a flange part of a quarter of FIG. 3A and FIG. 3E is a more detailed section of a beam part of the quarter of FIG. 3A, FIGS. 4A and 4C are a plan and perspective view respectively of a junction moulding for forming a seal between adjacent hypar panels and FIG. 4B is a section on the line B—B of FIG. 4A, FIG. 5A shows a fitting for attachment of internal restraining links between panels on different faces of the tank and FIG. 5B shows the fitting secured to a panel, FIG. 6A is a side elevation (with a part in section) of an internally braced tank similar to that of FIG. 1, but with a side wall removed to reveal internal bracing, and FIG. 6B is a plan view of the tank of FIG. 6A with most of the roof removed, FIG. 7A is a plan view of an alternative tank embodying the invention which is externally braced and FIGS. 7B and 7C are sections on the lines A—A and B—B respectively of FIG. 7A, and FIG. 8A is a plan view of a further alternative tank embodying the invention which is internally braced but has an external roof support structure, FIGS. 8B and 8C are sections on the lines A—A and B—B respectively of FIG. 8A and FIG. 8D shows an internal bracing arrangement which runs between opposite side walls of the tank of FIGS. 8A–C.

Referring firstly to FIG. 1, a storage tank in accordance with the invention, generally indicated as 10, has side walls 100, a base 200 and a roof 300. The side walls 100 and base 200 are constructed from a plurality of hypar panels 1 assembled so that the concave surfaces 3 all face outwardly of the tank. The panels 1 each consist of a laminate of plastics material, for example GRP, clad with a metal, for example, stainless steel, facing, the facings together defining the internal faces of the tank side walls and base. The panels 1 have, at their peripheral edges, respective protruding flanges 14 and 15. Opposed flanges of each panel are generally parallel to one another but the external side face of each flange is preferably provided with a 1° taper to assist removal of the panel parts from a mould during manufacture as later described. The flanges 14 of the panels 1 together define a peripheral flange generally indicated as 16 which extends around the peripheral edge of each external face of the side walls 100 and base 200 of the tank 10. The flanges 15 of the panels 1 together define a plurality of cross-flanges generally indicated as 18 which extend between opposed edges of the external face of each side wall 100 and base 200. The cross-flanges 18 are of strip-like configuration and have apertures (not shown) passing through them for receiving bolts (not shown) for interconnecting adjacent panels. Typically the bolts are plated steel of for example 12 mm diameter and 50 mm length for a 4 ft square panel.

Each panel 1 also has four upstanding spine beams 19 extending inwardly from the mid point of each lateral edge of the panel to a central part indicated generally as 12. At the central part 12 is an apertured boss 5 providing a central through passage 2 capable of receiving an anchor 32 (described in more detail later with reference to FIGS. 5A and 5B) for tank support structure members.

The roof 300 of the tank 10 is also constructed mainly from the hypar panels described above but for the roof, these are assembled so that their convex surfaces face outwardly of the tank. Where the panels are stainless steel clad laminates the metal cladding provides particularly efficient protection against the environment, though for the roof, the GRP panels need not be metal clad, nor indeed must they of necessity be of hypar configuration. A roof so constructed provides a natural drainage for rain water but an additional drainage system may be provided. At least one panel of the roof is preferably a man hole cover 302 allowing access to the tank and adapted to support ducting 306 enabling the tank to be filled with liquid. The roof is supported by a plurality of vertical posts 500 secured to anchoring points 32 located in through passages 2 of bosses 5 in panels 1 of the base 200 and roof 300 as shown in the sectional part of FIG. 1.

The tank 10 is provided with corner stiffening webs 20. These are preferably of angle section stainless steel and are preferably bolted on to the external faces of the panels 1 (though, less preferably, they could be included in edge panels during moulding thereof).

The tank 10 is supported in a position raised from the ground by I-section girders 400 to which the tank 10 is secured. The I-section girders 400 have one flange 402 secured to the ground and the other 404 supporting the tank 10. They should be sufficiently tall to allow access under the tank for bolting the panels 1 of the base 300 together. Secured to the external faces of the flanges 402 of the I-section girders 400 are support modules 406 upon which the central bosses 5 of respective panels rest. These modules 406 prevent any part of the panels other than their bosses 5 and flanges 14, 15 from coming into contact with an external support should the panels be deflected by the liquid load, thereby preventing load transmission through the relatively weaker parts of the panels.

In an alternative embodiment, the base of the tank is merely provided by a concrete floor to which the side wall panels 1 are sealably secured.

One construction of hypar panel of a tank in accordance with the invention will now be described with reference to FIGS. 2A–E, which panel is used in constructing the tank of FIG. 1. The panel consists of a one-piece moulding of a hypar shape. For ease of illustration, one of four identical quarter parts, generally indicated as 50, is shown in FIG. 2A the panel being symmetrical about the axes passing through points a–g. The panels have a dished configuration and, on assembly of the tank, the generally concave surfaces 66 of the panels define the external surfaces of the tank. The panel is constructed from a laminate of plastics material 54 (see FIGS. 2C and 2D), for example GRP, clad by a metal, for example, copper or aluminum, especially stainless steel. The bulk of the panel including external surface 66 is of GRP material but the convex surface 52 (which when part of a side wall or base of the tank, will define an interior surface part of the tank) is of stainless steel. The quarter part 50 has flange parts 58 upstanding from respective peripheral edges. A section of a flange part 58 is shown in more detail in FIG. 2D. As can be seen, the stainless steel layer 52 is embedded within the GRP material 54 and includes an upturned portion 53. The GRP material so profiled provides a particularly robust, but lightweight and material saving construction.

Each quarter part 50 also includes a pair of spine beam parts 80 the construction of which is shown in more detail in FIG. 2E. The beam parts 80 protrude externally from the generally dished surface of the panel quarter part 50.

The profile of a typical section of the quarter part 50, including both flange part 58 and beam part 80 in section is shown in FIG. 2C.

As previously mentioned, each panel has a central part (generally indicated as 12 in FIG. 1) at which is located a boss 5, a part 70 of which is shown in FIG. 2A.

The boss part 70 is defined by end regions of the beam parts 80 and a raised portion 71. As shown particularly in FIG. 2B, the boss has a central aperture 72 passing therethrough which defines the through passage 2 shown in FIG. 1.

An alternative form of panel is illustrated in FIGS. 3A–E which show a panel of similar hypar construction to that of FIGS. 2A–E and which is also constructed from metal clad GRP laminate. Again, for ease of illustration FIG. 3A illustrates one of four identical quarter parts. However, in the panel of FIGS. 3A–E, there are no beams protruding externally from the generally dished surface 66 of the quarter part 50; rather the metal clad surface 52 is profiled so as to provide a seat for sunken spine beam parts 60 of GRP material between the surface 66 and the metal clad surface 52. At a central part of the panel is located a boss 5, a part 70 of which is shown in FIG. 3A. The boss part 70 is defined by end regions of the sunken beam parts 60 and a raised portion 71. As in the panel shown in FIGS. 2A–E, the boss has a central aperture 72 passing therethrough.

Flange and beam details are shown particularly in FIGS. 3D and E respectively and a typical section across the quarter part including both flange part 58 and sunken beam part 60 is shown in FIG. 3C.

In order to seal adjacent panels to one another, junction mouldings are provided and a particularly preferred construction of moulding is shown in FIGS. 4A–C. These are of rubber and each consists of a base plate 24 having a generally octagonal shape, this configuration being preferred to save material. Upstanding from the base plate are four lips 26 provided with apertures 28. On assembly of the tank, the base plate lies adjacent to respective faces of panels to be sealed together and the lips 26 each lie adjacent respective flanges. Bolts are passed through apertures in the panel flanges and through the apertures 28 in the lips 26 to unite the junction mouldings to the corners of four respective panels to be sealed. The lips 26 are then firmly secured between the edges of the panels and the base plate 24 provides a planar surface facing towards the interior of the tank so that pressure of fluid in the tank urges the junction mouldings towards the panels. As can be seen particularly from FIG. 4C, a column 27 extends away from the base plate 24 and each lip 26 includes a stepped portion 29. The column 27 and stepped portions 29 provide a profile which conforms to that of the adjacent surfaces of the panels as moulded. This combination of a planar base plate 24 and profiled surface provides a particularly efficient seal. Modifications of this sealing arrangement are used for wall to base, wall to roof and wall to wall corner sealing.

As previously described, each panel 1 is provided with a boss 5 having a central through passage 2 (see FIG. 1) which is capable of receiving an anchor 32 for fixing one or more tank supporting members. The anchor may take the form of an I-section bolt passing through passage 2 and sealed externally and internally of the tank by O-rings between each respective flange of the I-section bolt and each respective end of the boss 5. Alternatively the anchor may take the form shown in FIGS. 5A and 5B. As can be seen clearly from FIG. 5B, the anchor generally indicated as 32 has a spindle 34 which passes through the passage 2 and receives a nut 38 which can be secured tightly against an O-ring 40 to secure the anchor in position. Sealing compound may be applied around the screw thread if desired. The spindle 34 carries a flange 42 which presses firmly against the internal surface of the panel 1 and carries an O-ring seal 44.

The tank support member carried by the anchor 32 of FIGS. 5A and 5B is a tensioning device forming part of the internal bracing of a tank shown in more detail with reference to FIGS. 6A and 6B. This tensioning device takes the form of a wire rope 39 received by a drop forged open socket 36 pivotally connected to anchor 32. The rope 39 extends under tension to a similar device fitted in a panel 1 of the tank 10. In a 4 ft high tank these tensioning wires run across the tank from opposite walls. With tanks 8 ft high or more additional bracing is provided as shown in FIGS. 6A and 6B. In an alternative form of bracing, wire ropes 39 are replaced by a solid steel rod.

FIGS. 6A and 6B illustrate a tank 1000 similar to tank 10 of FIG. 1, but having side walls each having six panels 1 (as opposed to the five panels of the side walls of the tank of FIG. 1). In the tank 1000 of FIGS. 6A and 6B the roof 300 is supported by a plurality of vertical posts 500. Preferably, there are at least two roof support posts 500 between base 200 and roof 300 for each row of six adjacent panels. As can be seen from the sectioned part of FIG. 6A, the roof support posts 500 are each fixed at opposite ends to anchors 32 secured in the bosses 5 of respective base and roof panels 1. The bosses 5 of the base panels are each supported by a support module 406 as described with reference to FIG. 1. The tank 1000 is internally braced by tensioning members generally indicated as 600 which run across the tank from opposite walls. There are preferably two such tensioning members 600 at each level A-D shown in FIG. 6A. These tensioning members 600 consist of wire ropes 39 which may be up to 20 mm in diameter. These wire ropes 39 should not be deflected, e.g. around roof support posts 300, since this would adversely affect their tensioning ability. Where the tensioning members 600 across the path of a roof support post 500, they each comprise a plurality of wire ropes 39 each under tension and pivotally connected at least at one end to a sleeve 502 surrounding the roof support post. For tall tanks such as that shown in FIGS. 6A and 6B additional bracing in the form of angle section stainless steel strips 602 are provided at least in the lower corners of the tank, these extending respectively from an anchor 32 in the boss 5 of the lowermost side wall corner panel 1' at level A (see FIG. 6A) to an anchor 32 in the boss of the adjacent base panel 1' similarlyt from a side wall panel 1'' at level B to a base panel 1'' adjacent to base panel 1'. This additional bracing provides stability under wind loading.

An alternative form of tank 2000 is shown in FIGS. 7A–7C. This tank contains no internal bracing and is particularly suited for the storage of e.g. corrosive fluids where contact with internal bracing is to be avoided. The tank 2000 is constructed from hypar panels 2001 which are similar to those of the panels 1 of the tank 10 of FIG. 1 but do not have through passages 2 extending through bosses 2012 thereof. The tank 2000 is externally braced to withstand both the load of the fluid which it is to contain and wind loading. The external bracing includes eight vertical I-section girders 2020, two adjacent each side wall of the tank. Three horizontal channel section members 2022 surround the tank at respective vertical levels, the channels facing away from the tank. These are welded to vertical I-section girders 2020. Tie rods 2024 under compression are secured between each horizontal channel section member 2022 and the central boss 2012 of each side wall panel 1. Each boss is provided with a tapped or locating hole (not shown) for location of an axial end of the tie rod 2024 within the boss 2012.

The tank 2000 is supported on a base 2030 by a plurality of I-section girders 2032 disposed horizontally with one flange 2031 secured in face to face relation with the base 2030 and the other flange 2033 running beneath the central parts of a row of base panels 1. Support modules 2034 bolted to the flanges 2033 of the I-section girders 2032 prevent the base panels 1 from coming into contact with the external support structure at any point other than the bosses 2012.

Strengthening ties 2036 also run horizontally beneath opposed side walls of the tank, these ties being secured to and extending laterally between the outermost of the horizontal I-section girders 2032 beneath the tank base and a lower part of the vertical I-section girders 2020.

In addition to forming part of the tank side wall support structure, the vertical I-section gireders 2020 also form part of the tank roof support. Thus, the upper end 2038 of each of a pair of opposed I-section girders 2020 supports a respective longitudinal end of a roof beam 2040 or 2042 running horizontally above the tank roof and extending laterally beyond each side wall. Two of these beams 2040 are main I-section beams running between front and back side walls of the tank, while the other two beams 2042 are of box section and run between the other two tank side walls. Further box section roof cross beams 2044 run between but terminate short of opposed tank side walls. Bosses 2012 of the roof panels are secured to the various beams.

In an alternative construction to those described above, a hypar tank embodying the invention is provided with internal bracing but with an external roof support. Such a tank is shown in FIGS. 8A–D. The tank, generally indicated as 3000, has an internal bracing 3002 similar to that described with reference to FIGS. 6A and 6B but no roof columns. The external support 3004 is similar to that described with reference to FIGS. 7A–C but the I-section girders 2020 of FIGS. 7A–C (which in that embodiment may be as large as 21″×8″) are replaced by much smaller (e.g. 3″×4″) box section girders 3006 which support only the roof 3008. In addition there is no external side wall bracing.

Thus the internal bracing consists of a plurality of dual rod tie arrangements generally indicated as 3010 (and shown in more detail in FIG. 8D) running generally horizontally between opposed panels of opposite side walls (see especially FIG. 8A) and a plurality of single rod ties 3012 or 3013 running generally horizontally between opposed panels of front and back wall panels (see especially FIG. 8B). With this arrangement the tie bars may pass each other without either deflecting them out of the horizontal or dividing them into sections as described with reference to FIGS. 6A and 6B. As can be seen more clearly from FIG. 8D, each dual rod tie arrangement consists of a pair of parallel tie rods 3014 or 3015 opposite ends of which pass through apertures in a respective plate 3016 to which they are bolted. Each plate 3016 is carried by a single rod 3018 secured to an anchor 32 sealed within through passage 2 in boss 5 of panel 1.

For more efficient bracing the rods 3014 at lower levels of the tank which experience the greater load on filling the tank (e.g. those running between the lowermost panels and between the panels immediately above these) are preferably of a larger diameter than those 3015 running between panels at upper levels. For a tank of 4′ square panels which is four panels high typical diameters are 14 mm for the lower 3014 and 10 mm for the upper level rods 3015 of dual rod tie arrangements 3010.

Similarly the single rods 3012 at lower levels of the tank 300 are preferably of a larger diameter than those 3013 at upper levels. For a tank of 4′ ; square panels which is four panels high typical diameters are 20 mm for the lower and 14 mm for the upper levels.

The tank 3000 is supported on a base 2030, in the same manner as the tank 2000 described with reference to FIGS. 7A–C, by a plurality of I-section girders 2032 to which are bolted support modules 2034 which support bosses 5 of panels 1.

The roof support structure is carried by the two pairs of box section girders 3006 the upper ends 3020 of which each carry a respective longitudinal end of a roof beam 3022 or 3024 running horizontally above the tank roof and extending laterally beyond each side wall. Two of these beams are channel section beams 3022 running between front and back walls of the tank and the other two are box section beams 3024 running between opposite side walls. Further box section roof cross beams 3026 run between but terminate short of opposed tank side walls.

The tank 3000 is also provided with corner stiffening webs 10 of, for example, 75×75×3 mm angled stainless steel. These run both horizontally and vertically.

This construction is particularly cost-effective and is especially suitable for tanks intended to store water and represents the best embodiment.

Hypar tanks in accordance with the invention may withstand particularly high loads provided by both the liquid they are intended to carry and wind loading. For example a tank having 4 ft square panels may remain stable, with no leakage of liquid or permanent deformation of the tank even when storing large quantities of liquid such that the base panels are subjected to a pressure of up to 7 psi. Tanks having flat GRP panels of a corresponding size will not stand up to this loading without permanent deformation or failure.

When a hypar tank is subjected to loading, the internal spine beams of the panels resist the transverse component of load and transmit this to the central support. The flanges take the horizontal component of the spine beam load. The load is thus distributed throughout the tank to provide a particularly stable and robust tank construction from panels having an extremely high strength/weight ratio.

Since, as mentioned above, the central boss part of the panel takes the maximum load, care must be taken to ensure that only this part comes into contact with the external or internal bracing or support members so that the load is not transmitted through the relatively weaker regions of the panels.

In addition to the abovementioned advantages of high strength/weight ratio, hypar panels have the advantage that a panel at least as light as a conventional GRP panel can be easily manufactured by moulding hypar panels and assembling them together as described above.

A typical metal clad GRP laminate hypar panel is constructed as follows.

A thin stainless steel sheet (1 mm thick) is formed into the shape of a hyperbolic paraboloid with flanges by pressing. As previously mentioned, the external faces of the respective flanges are provided with a 1° taper to facilitate removal of the molded hypar panel from the mould. The inside surface of the tray shape so formed is solvent degreased and treated with a urethane acrylate coating at 200 g/m$^2$.

The shaped primed metal tray is then transferred to a female tool of the same shape in a press. A charge of sheet moulding compound (SMC) sufficient to give the required thickness laminate is then loaded and the mould closed. Under the influence of pressure and heat the SMC flows and cures so that when released a stainless steel clad GRP panel is obtained. The panels may then be assembled to form hypar tanks as described above.

Whilst the panels described above are of metal clad GRP laminate, panels may alternatively be made of metal, preferably steel, alone, metal clad cement based concrete, metal clad resin concrete, unfaced GRP or with low void content cement (see EP 55035) with the same advantages of improved strength/weight ratio.

We claim:

1. A fluid storage fluid tank having side walls each assembled from a plurality of panels interconnected with one another, each said panel being of hyperbolic paraboloid shape arranged to have its concave surface facing out, and each said panel having lateral edges along which run raised portions which together define a continuous flange and a plurality of spine beams extending essentially from respective mid points of the lateral edges of the panels to a reinforcing boss at a raised central region to provide interconnection between the bosses and flanges within each panel and the adjacent panels being interconnected at their flanges, means for supporting said side walls by applying support to said bosses, whereby liquid load of a filled tank on the surfaces of the respective panels is transmissible to the said flanges and spine beams which are in turn, by said support means, capable of distributing the load throughout the tank.

2. A storage tank according to claim 1, which additionally includes external bracing under compression.

3. A storage tank according to claim 1, which additionally has a base assembled from a plurality of panels interconnected with one another, each said panel being of hyperbolic paraboloid shape and arranged to have their generally concave surface facing out.

4. A storage tank according to claim 1, which additionally has a roof assembled from a plurality of panels interconnected with one another, at least some of the said roof panels being of hyperbolic paraboloid shape and arranged to have their generally convex surface facing out.

5. A storage tank according to claim 1, wherein the said side wall panels are each of fibre reinforced plastics material having a metallic facing, the said facings of respective said panels together defining an internal surface of the tank.

6. A storage tank according to claim 1, wherein the said spine beams are each upstanding from the concave surface.

7. A storage tank according to claim 1, wherein the said spine beams are each upstanding from the convex surface.

8. A storage tank according to claim 1, which additionally includes sealing members at each junction defined by respective adjacent corners of adjacent said panels, which sealing members each provide a planar surface facing internally of the tank so that fluid pressure against the said respective surfaces forces the said sealing members into fluid tight sealing engagement with the said panels.

* * * * *

UNITED STATES PATENT AND TRADEMARK OFFICE

CERTIFICATE OF CORRECTION

PATENT NO. : 4,838,449

DATED : 13 June 1989

INVENTOR(S) : Jarnott et al

It is certified that error appears in the above-identified patent and that said Letters Patent is hereby corrected as shown below:

Col. 1, line 32
"(2" x 4") should be --(2' x 4').--

Col. 2, line 21
"draining" should be --drainage--

Col. 8, line 8
delete the semi-colon

Col. 9, line 21
delete "fluid" (2nd)

Signed and Sealed this

Twenty-sixth Day of December, 1989

*Attest:*

JEFFREY M. SAMUELS

*Attesting Officer* *Acting Commissioner of Patents and Trademarks*